United States Patent [19]

Suzuki

[11] 3,982,396

[45] Sept. 28, 1976

[54] THERMAL REACTOR WITH SLIDABLE SUPPORTS FOR INNER CORE

[75] Inventor: Motoo Suzuki, Kyoto, Japan

[73] Assignee: Mitsubishi Jidosha Kogyo Kabushiki Kaisha, Tokyo, Japan

[22] Filed: May 28, 1975

[21] Appl. No.: 581,651

[30] Foreign Application Priority Data

Sept. 6, 1974 Japan ..... 49-103186

[52] U.S. Cl. ..... 60/282; 60/323; 60/322

[51] Int. Cl.[2] ..... F01N 3/10; F01N 7/10

[58] Field of Search ..... 60/322, 323, 282

[56] References Cited

UNITED STATES PATENTS

| | | | |
|---|---|---|---|
| 3,645,092 | 2/1972 | Tatsutomi et al. | 60/322 |
| 3,653,205 | 4/1972 | Tadokoro | 60/322 |
| 3,727,410 | 4/1973 | Scheitlin et al. | 60/322 |
| 3,898,804 | 8/1975 | Morita | 60/282 X |
| 3,940,927 | 3/1976 | Maurhoff et al. | 60/323 |

*Primary Examiner*—Carlton R. Croyle
*Assistant Examiner*—Thomas I. Ross
*Attorney, Agent, or Firm*—Oldham & Oldham Co.

[57] ABSTRACT

The thermal reactor comprising a shell, a core in the shell, an inlet pipe being fixed at one end to the shell and extending sealingly through the core, and an outlet pipe. A convex portion on the periphery of the core is slidably supported in a concave portion formed in the shell and the outlet pipe is fixed thereto and to the core, thereby permitting relative movements therebetween due to thermal deformation and preventing generation of noise and vibration of each member.

3 Claims, 2 Drawing Figures

THERMAL REACTOR WITH SLIDABLE SUPPORTS FOR INNER CORE

BACKGROUND OF THE INVENTION

This invention relates to a thermal reactor for treating exhaust gas from an engine of a motor vehicle.

In conventional thermal reactors, it is necessary to arrange a shell and a core received therein such that they are permitted to deform relatively to each other due to thermal expansion thereby preventing their damages and that the core is supported in the shell to prevent generations of excessive vibrations and noises.

In order to solve the above technical problems, we have made various utility tests on the thermal reactor in which an inlet pipe attached to the shell is inserted into said core so as to slide relative thereto and an outlet pipe attached to the core is slidably supported in an outlet opening in the shell, in which the core designed as described above is located. As a result, it has been experienced that abnormal wear and unpleasant noises are generated at sliding portions between the shell and the core and between the outlet pipe and the shell because of vibrations of the engine and vibrations generated upon running of the vehicle, since said core is floatingly suspended within the shell. That is to say, the core, the shell, the inlet pipe, and the outlet pipe have no fixed portion which is a base point upon relative movements therebetween due to the thermal expansion. Therefore, the core is retained in floating condition within the shell to produce play on the sliding portion of each member by vibrations generated during running of the vehicle and operation of the engine, thereby causing vibrations and abnormal noises and further increasing wear at each sliding portion. Also, it has been experienced that the exhaust gas enters directly into a space between the core and the shell and then is discharged to the atmosphere without reburning of the exhaust gas within the core, because after a long period of use, play is produced at the sliding portions between the inlet pipe and an inlet portion of the core and between the outlet pipe and an outlet portion of the shell.

This invention is to provide an improved thermal reactor in which the above drawbacks in the invention of our aforementioned application are avoided.

SUMMARY OF THE INVENTION

According to the invention, there is provided a thermal reactor comprising a shell formed from two divided pieces which are joined to each other at circumferential flanges thereof, a tubular core slidably held at a convex portion provided on a longitudinal outer periphery of the core within a concave portion provided at the jointed portion of the flanges on a longitudinal inner periphery of the shell, at least one inlet pipe being fixed to said shell and extending through said core in a fluid tight manner by a seal ring, an outlet pipe fixed at one end to said core and at the other end to an outlet open end in said shell, and an adiabatic space defined between said shell and core, an outlet end of said outlet pipe being connected to an exhaust pipe of an engine.

BRIEF DESCRIPTION OF THE DRAWINGS

This invention will be explained by way of example with reference to the accompanying drawings in which.

DESCRIPTION OF THE PREFERRED EMBODIMENTS

Figure 1:
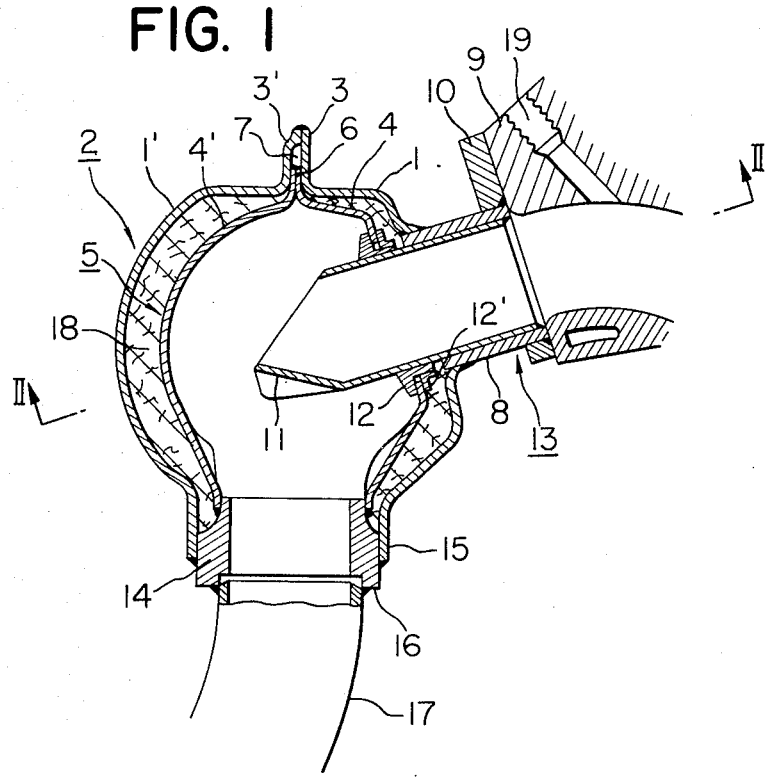
FIG. 1 shows a longitudinal transverse cross section of the thermal reactor according to the invention.
Figure 2:
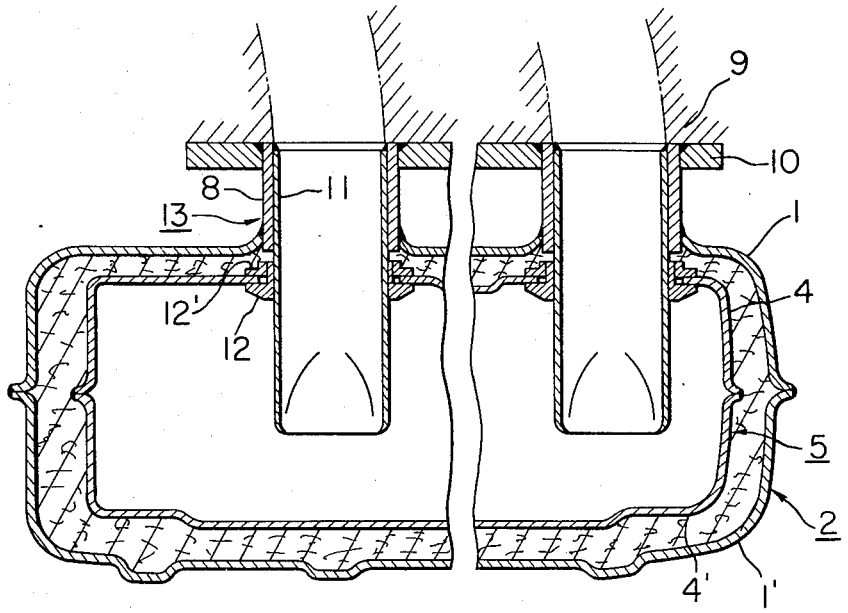
FIG. 2 shows a cross sectional view taken along the line II — II in FIG. 1.

In the drawings, a thermal reactor includes a shell 2 formed from two divided shell pieces 1 and 1' which are integrally joined to each other through circumferential flanges 3 and 3' by bolts, welding or other suitable means. Similarly, a tubular core 5 supported in the shell 2 is formed from two divided core pieces 4 and 4' which are joined to each other by for example welding. A convex portion or flange 6 projects outwardly from a longitudinally outer peripheral part of the core 5. The portion 6 is inserted and supported in a concave portion 7 defined between longitudinal inner peripheries of the flanges 3 and 3' on the upper portion of the shell 2, so as to slide longitudinally and radially in the concave portion. The thermal reactor has one or more inlet pipes 13 which correspond to the number of cylinders of an engine 9. Each inlet pipe 13 consists of an outer inlet pipe 8 and an inner inlet pipe 11 fixed thereto. The outer inlet pipe 8 is fixed at one end to the shell 2 and has a flange 10 on the other end for securing it to the engine 9 by bolts not shown. The inner inlet pipe 11 fixed to the outer inlet pipe 8 extends through the core 5 and is operatively secured thereto in a fluid tight manner by engaging seal rings 12 and 12' that are slidable along the periphery of the inner inlet pipe 11.

An outlet pipe 14 is fixed at one end to a lower opening of the core 5 and joined at a peripheral portion to an outlet open end 15 provided on the lower portion of the shell 2 by for example welding. An outlet end 16 of the outlet pipe 14 is securely connected to an exhaust pipe 17 of the engine. An adiabatic material 18 having high heat resistance is filled in an adiabatic space defined between the shell 2 and core 5 according to requirements. Numeral 19 designates a secondary air supply port for supplying secondary air which is supplied from an air pump, not shown, and used for causing reburning of the exhaust gas in the thermal reactor.

According to the construction of the above embodiment of this invention, the exhaust gas from the engine 9 enters into the core 5 through the inlet pipe 13 and is reburned within the core 5 by the secondary air from the port 19 to reduce production of hydrocarbon and carbon monoxide. Thereafter, the purified exhaust gas is discharged from the outlet pipe 14 to the atmosphere through the exhaust pipe 17.

When the temperature in the core 5 rises or drops, the core 5 and shell 2 are thermally expanded or contracted to cause relative movement therebetween. In the thermal reactor according to the invention, the core 5 is fixed to the shell 2 through the outlet pipe 14, so that the core 5 can perform extremly stable longitudinal sliding movements about this fixed portion which is a base point for such movements, while the convex portion 6 of the core is slidably supported in the concave portion 7 between the flanges 3 and 3'. Also, radial expansion and contraction of the core 5 due to its thermal expansion and contraction is permitted without damage to the core 5 or core 5, since the inlet pipe 13 is allowed to move freely relative to the inlet pipe 13 and the convex portion 6 can freely move radially within the concave portion 7 of the shell.

As apparent from the above embodiment according to the invention, the core 5 is fixed at one portion to the shell 2 through the outlet pipe 14 and spaced portions of the core are supported to permit the sliding movements relative to the shell as described above. Therefore, the core 5, inlet pipe 13 and outlet pipe 14 are effectively supported in the shell 2 against vibrations during the vehicle's running and yet they are permitted their thermal expansions and contractions. Also, generation of play between each member, damage thereof and generation of noises are effectively prevented, because excessive movement of each member is prohibited.

Since generation of large amount of play due to abnormal wear and deformations will not be caused, entrance of the exhaust gas into the space between the core 5 and shell 2 and damage of the adiabatic material 18 by the exhaust gas are prevented, thereby increasing durability of the thermal reactor without loss of effectiveness of the thermal reactor for a long period of time. As described above, this invention has specific advantages which can not be obtained by the conventional thermal reactor.

What is claimed is:

1. A thermal reactor comprising a shell formed from two pieces having flanges extending outwardly from the interior of the shell, which pieces are joined to each other at the flanges thereof and which flanges define a concave portion, a tubular core formed from two pieces having flanges extending outwardly from the interior of the core, which second-named pieces are joined to each other at the flanges thereof and which flanges define a convex portion, said convex portion being slidably supported within said concave portion, said core having a discharge opening, said shell having an outlet open end, a space being provided between said shell and core, at least one inlet pipe secured to said shell and extending therethrough into the core, seal ring means slidably positioned on the inlet pipe and engaging the core in a fluid tight manner, and an outlet pipe secured at one end to said core to connect to said opening, said outlet pipe also being secured at a peripheral portion thereof to the outlet open end in said shell, and adiabatic material having high heat resistance in the space defined between said shell and core, an outlet end of said outlet pipe being connected to an exhaust pipe of an engine.

2. A thermal reactor according to claim 1, wherein said seal ring means is movably affixed to said core to permit radial thermal expansion of said core relative to the inlet pipe.

3. A thermal reactor according to claim 2, wherein said inlet pipe consists of an outer member and an inner member secured to the outer member and extending into said core through said seal ring means, one end of said outer member being secured to said shell while the other end thereof is secured to the engine by a flange provided on the outer member.

* * * * *

UNITED STATES PATENT OFFICE

CERTIFICATE OF CORRECTION

PATENT NO. : 3,982,396

DATED : September 28, 1976

INVENTOR(S) : Motoo Suzuki

It is certified that error appears in the above-identified patent and that said Letters Patent are hereby corrected as shown below:

Column 2, line 14, after "longitudinally", insert --extending--.

Signed and Sealed this

Eighteenth Day of January 1977

[SEAL]

*Attest:*

RUTH C. MASON
*Attesting Officer*

C. MARSHALL DANN
*Commissioner of Patents and Trademarks*